US005103782A

United States Patent [19]

Matsui

[11] Patent Number: 5,103,782

[45] Date of Patent: Apr. 14, 1992

[54] OIL PAN FOR INTERNAL COMBUSTION ENGINE

[75] Inventor: Kentaro Matsui, Yokohama, Japan

[73] Assignee: Nissan Motor Co., Ltd., Yokohama, Japan

[21] Appl. No.: 597,668

[22] Filed: Oct. 17, 1990

[30] Foreign Application Priority Data

Oct. 20, 1989 [JP] Japan ..... 1-122783[U]

[51] Int. Cl.[5] ..... F01M 11/06

[52] U.S. Cl. ..... 123/195 C; 184/106

[58] Field of Search ..... 123/195 C, 196 R, 198 E; 184/6.5, 106

[56] References Cited

U.S. PATENT DOCUMENTS 4,270,497 6/1981 Valerio ..... 123/195 C 5,038,890 8/1991 Tanaka et al. ..... 123/196 R

FOREIGN PATENT DOCUMENTS 53-16048 5/1978 Japan .

*Primary Examiner*—Noah P. Kamen

*Attorney, Agent, or Firm*—Foley & Lardner

[57] ABSTRACT

An oil pan for an internal combustion engine wherein the oil dropped on a shallow bottom section is rapidly returned into a sump. A plurality of guide ribs are disposed on the downstream side of the shallow bottom section which is located at the downstream side of the oil flow caused by the rotation of a crankshaft of the engine. The guide ribs are formed in an arcuate shape so as to curve toward the sump as they approach a side wall located at the downstream side, by which the oil flow is directed toward the sump. Additionally, a guide plate formed integrally with a baffle plate extends upwardly to guide the flowing oil into the sump.

10 Claims, 5 Drawing Sheets

OIL PAN FOR INTERNAL COMBUSTION ENGINE

BACKGROUND OF THE INVENTION

1. Field of the Invention

This invention relates to an improvement in an oil pan for an internal combustion engine, and more particularly to an oil pan in which the oil dropped on a shallow bottom section is rapidly returned into a sump.

2. Description of the Prior Art

An internal combustion engine for an automotive vehicle is usually provided with an oil pan having a sump into which lubricating oil dropped in the oil pan is collected to be fed to various sections of the engine by an oil pump. In order to effectively return the lubricating oil into the sump, it has been proposed that an oil pan have a plurality of guide ribs on a shallow bottom section of the oil pan as shown in FIG. 6 of the present application. Such an arrangement is disclosed, for example, in Japanese Patent Publication No. 53-16048.

As shown in FIG. 6, an oil pan 21 includes a sump 22 disposed under a cylinder block (not shown), and extends along the axis of a crankshaft (not shown). A shallow bottom section 23 is disposed under the cylinder block and defines a space which communicates with the sump 22. An oil strainer (not shown) is disposed in the sump 22. A generally straight rib 24 is formed at the upper surface on one side of the shallow bottom section 23 which side is located downstream of the oil flow caused by the rotation of the crankshaft. The straight rib 24 extends generally in the longitudinal direction of the engine. A plurality of arcuate ribs 25 are formed at the upper surface on the side of the shallow bottom section 23 which side is located upstream of the oil flow caused by the rotation of the crankshaft. Lubricating oil in the shallow bottom section 23 is forced in the direction indicated by arrows A under the rotation of the crankshaft. This causes the lubricating oil to be rapidly returned from the shallow bottom section 23 into the sump 22. The shallow bottom section 23 is located considerably near the crankshaft since modern engines tend to be formed smaller.

However, with this conventional arrangement, lubricating oil guided by the ribs 25 flows into the sump section 22 through a flat section 26 which is formed between the rib 24 and end 25*a* of the each rib 25. Additionally, the lateral width of the flat section 26 gradually becomes narrower toward the sump 22, and the amount of the oil directed to the sump 22 increases on the flat section 26 as its approaches the sump 22. The oil on the flat section 26 overflows the ribs 24 and 25 in the vicinity of the sump 22 and is splashed by air flow caused by the high speed rotation of the crankshaft and the like, so that the oil is prevented from returning into the sump 22. Furthermore, since the flat section 26 is located just under the crankshaft with a short distance between them, the oil on the flat section 26 receives a strong air flow force caused by the high speed rotation of the crankshaft and the like, so that the oil is further prevented from returning into the sump 22.

Therefore, the lubricating oil tends to be splashed by the crankshaft and connecting rods. This splashing causes a low oil level in the sump 22, and therefore air is sucked into the oil flow circuit through the oil strainer. Thus, a large amount of air bubbles are mixed with the oil.

SUMMARY OF THE INVENTION

It is an object of the present invention to provide an improved oil pan for an internal combustion engine whereby lubricating oil on the shallow bottom section can be effectively returned to a sump, overcoming the drawbacks encountered in conventional oil pans.

An oil pan for an internal combustion engine, according to the present invention, comprises a shallow bottom section fixedly disposed under a cylinder block of the engine. The shallow bottom section has a bottom surface defining thereover a space in which a crankshaft is disposed. A sump section defining a sump is located under the cylinder block of the engine. The sump section is connected to the shallow bottom section so that the sump communicates with the shallow bottom section space. The sump has a lower part which is lower in level than the shallow bottom section. At least one guide rib is fixedly disposed on the shallow bottom section at one side which is located downstream of oil flow caused by the rotation of the crankshaft. The guide rib is curved toward the sump as it approaches the downstream side of the shallow bottom section.

With this arrangement, the sump in the oil pan always stores a sufficient amount of oil so that system is prevented from sucking air bubbles into the oil. Therefore, the various parts of the engine are more suitably lubricated.

DETAILED DESCRIPTION OF THE INVENTION

Figure 1:
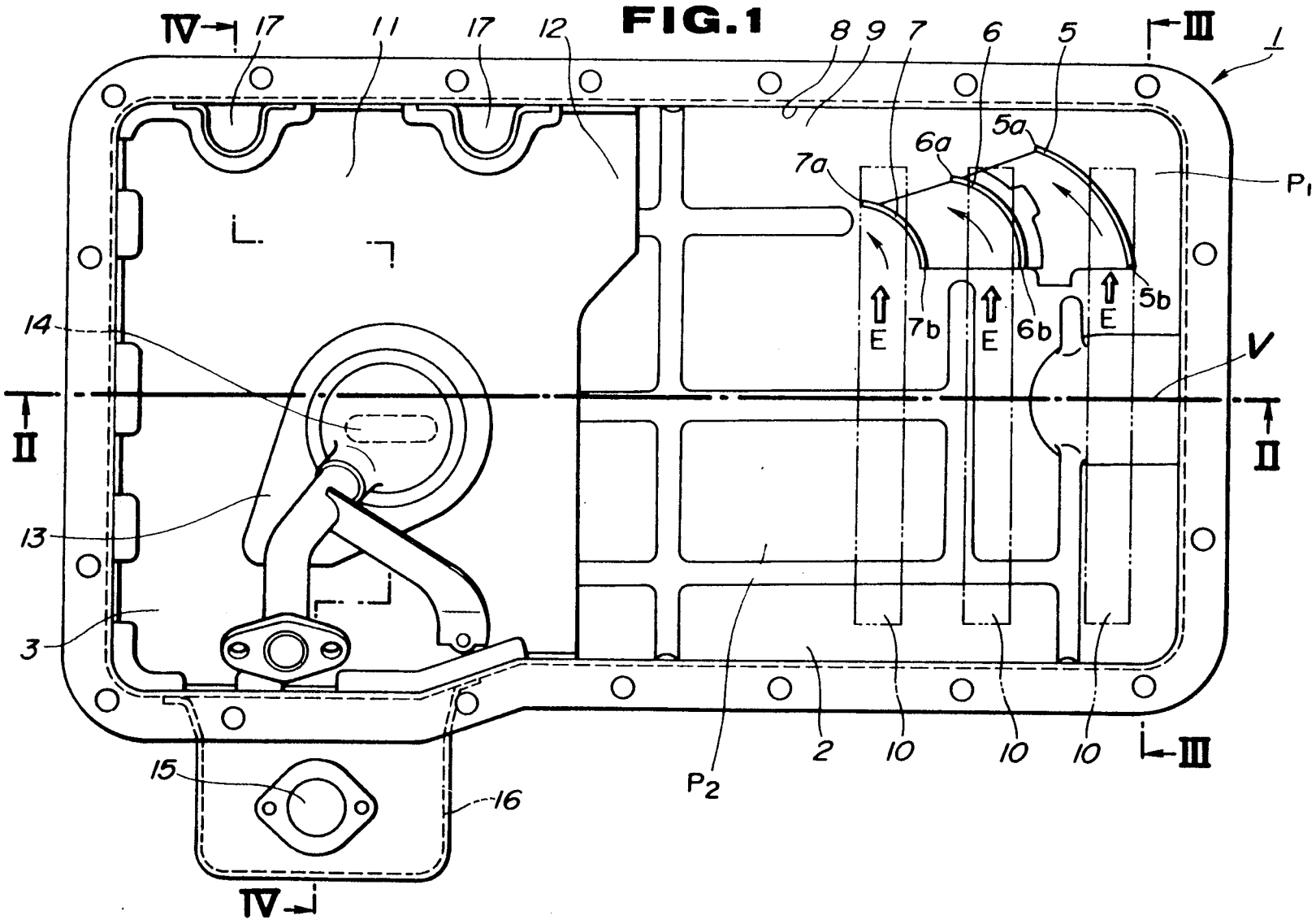
FIG. 1 is a plan view of an embodiment of an oil pan according to the present invention.
Figure 2:
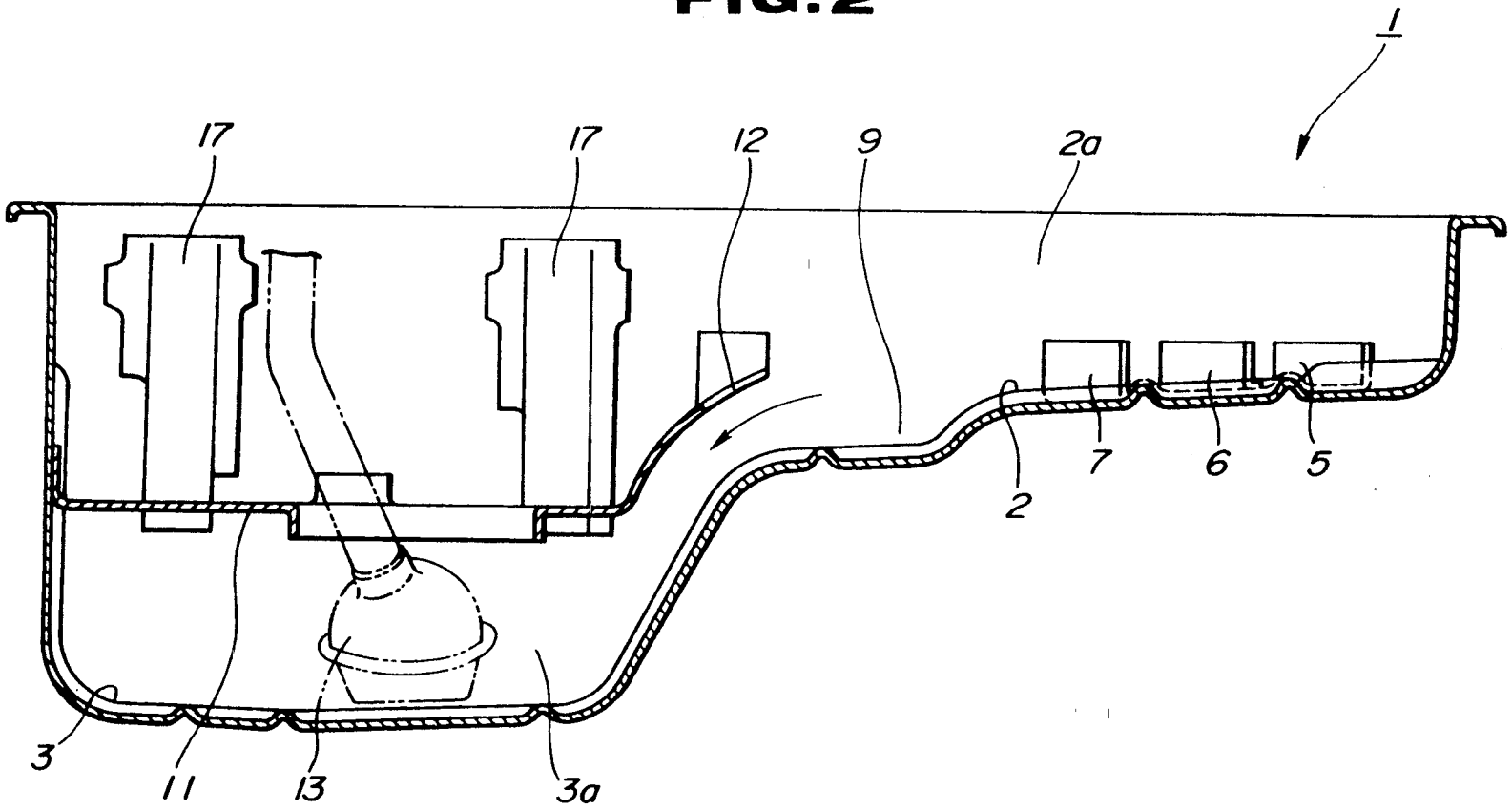
FIG. 2 is a longitudinal cross-sectional view of the oil pan taken in the direction of the arrows substantially along the line II—II of FIG. 1.
Figure 3:
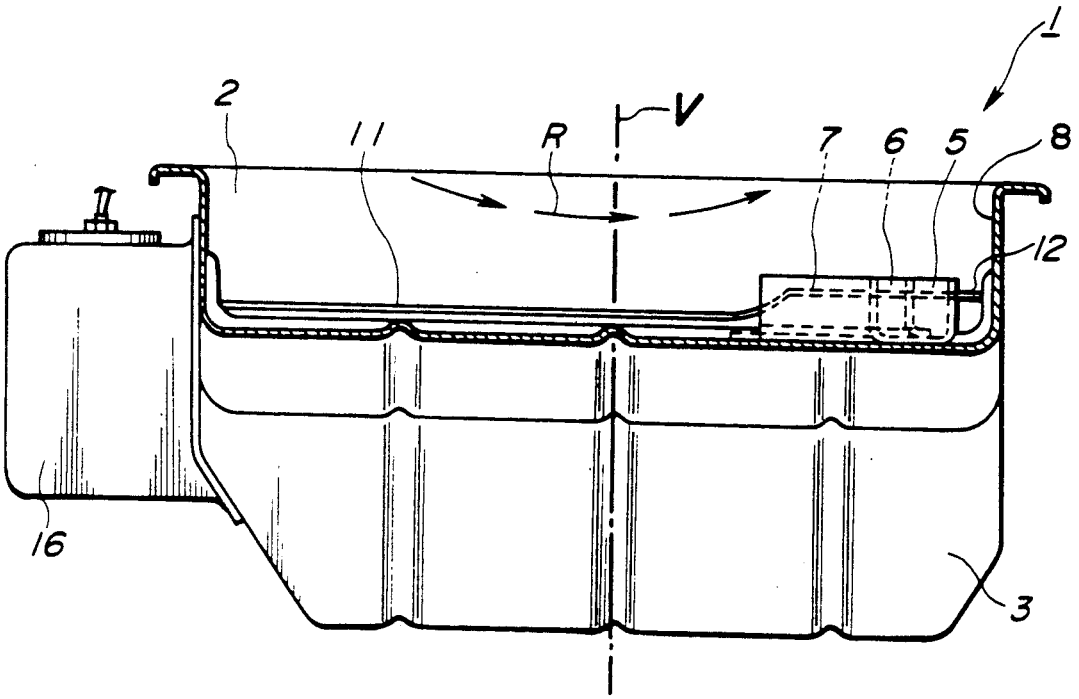
FIG. 3 is a side cross-sectional view of the oil pan taken in the direction of the arrows substantially along the line III—III of FIG. 1.
Figure 4:
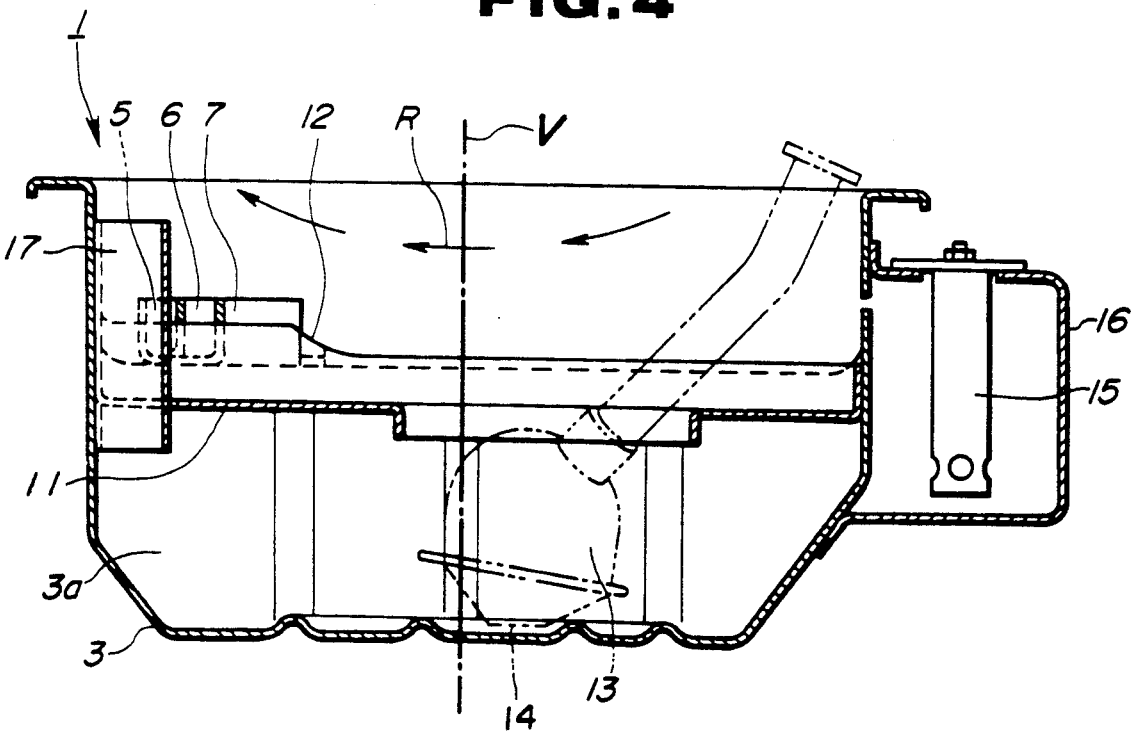
FIG. 4 is a side cross-sectional view of the oil pan taken in the direction of the arrows substantially along the line IV—IV of FIG. 1.

Referring now to FIGS. 1 to 5, there is shown an embodiment of an oil pan 1 for an internal combustion engine, according to the present invention. The oil pan 1 comprises a shallow bottom section 2 defining a shallow bottom space 2*a*. A sump section 3 is integrally connected with the shallow bottom section 2 and defines a sump 3*a* in which lubricating oil is stored. In FIGS. 1, 3 and 4, character V indicates an imaginary vertical plane including an axis of a crankshaft (not shown). The vertical plane V divides the shallow bottom section 2 into first and second parts $P_1$, $P_2$. The first part $P_1$ is located downstream of the second part $P_2$ with respect to the oil flow caused by the rotation of the crankshaft. The shallow bottom section 2 includes a side wall 8 which forms part of the side surface of the oil pan 1. The side wall 8 is disposed at the downstream side of the oil flow caused by the rotation of the crankshaft as shown in FIGS. 1 and 3.

First, second and third guide ribs 5, 6, 7 are formed so as to upwardly extend from the shallow bottom section 2. The guide ribs 5, 6, 7 are disposed on a first part $P_1$ of the shallow bottom section 2. The guide ribs 5, 6, 7 are arranged in parallel and located such that the first guide rib 5 is the farthest from the sump 3a while the third guide rib 7 is the nearest to the sump 3a, the second guide rib 6 being between the guide ribs 5 and 7. The guide ribs 5, 6, 7 are gradually curved toward the sump 3a as they approach the side wall 8, so that downstream ends 5a, 6a, 7a of the guide ribs 5, 6, 7 are generally directed toward the sump 3a as shown in FIG. 1. Furthermore, in this embodiment the upstream ends 5b, 6b, 7b of the guide ribs 5, 6, 7 are generally located respectively under positions which are between counterweights whose rotational loci are indicated by reference numeral 10 in FIG. 1.

It is well known that modern engines are designed to have a short distance between the bottom section of the oil pan 1 and a rotational system (not shown) which includes the crankshaft, in order to lower the level of a bonnet with which an engine room is covered.

In this embodiment, the lengths of the guide ribs 5, 6, 7 are formed to be not larger than one-third of the lateral width of the oil pan 1 so that the crankshaft can be located adjacent the shallow bottom section 2. With such shorter guide ribs 5, 6, 7, the effect of changing the direction of the oil flow caused by the rotation of the crankshaft is sufficiently obtained. Furthermore, it will be understood that the guide ribs may be formed to extend near the plane V if a sufficient distance is allowed between the shallow bottom section 2 and the rotational system.

A baffle plate 11 for suppressing the shake of the oil level is fixedly disposed at the upper part of the sump 3a. The baffle plate 11 is fixedly attached to the inner wall surface of the sump section 3. The baffle plate 11 has a guide plate 12 which is generally located opposite the downstream ends 5a, 6a, 7a of the guide ribs 5, 6, 7 in the direction parallel with the axis of the crankshaft. The guide plate 12 extends upwardly and has a width larger than the distance defined between the downstream end 7a and the side wall 8.

As shown in FIG. 4, the oil inlet 14 of an oil strainer 13 is disposed on the opposite side of the plane V relative to the guide plate 12. An oil level sensor 15 is disposed in a sensor chamber 16 which is similarly disposed on the opposite side of the plane V relative to the guide plate 12. The oil which has lubricated an engine valve operating system (not shown) and the like is fed to the sump 3a through oil guide tubes 17. The oil guide tubes 17 are disposed under the openings of oil passages (not shown) formed in the cylinder block (not shown).

Figure 5:
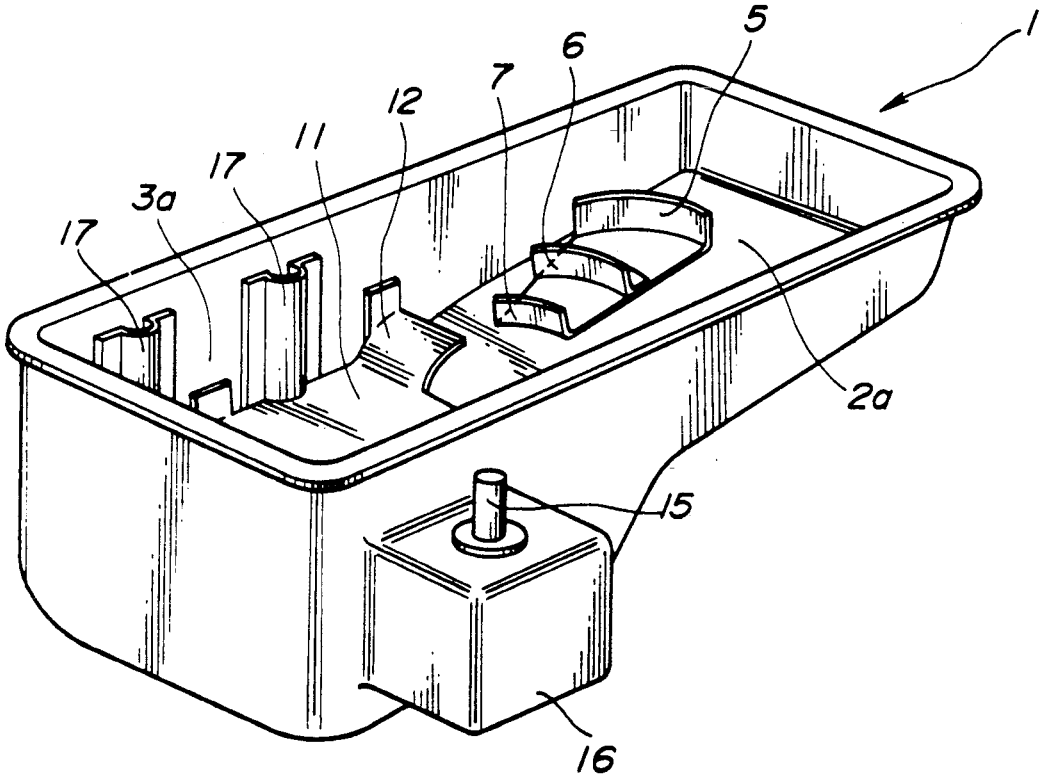
FIG. 5 is a perspective view of the oil pan of FIG. 1.
Figure 6:
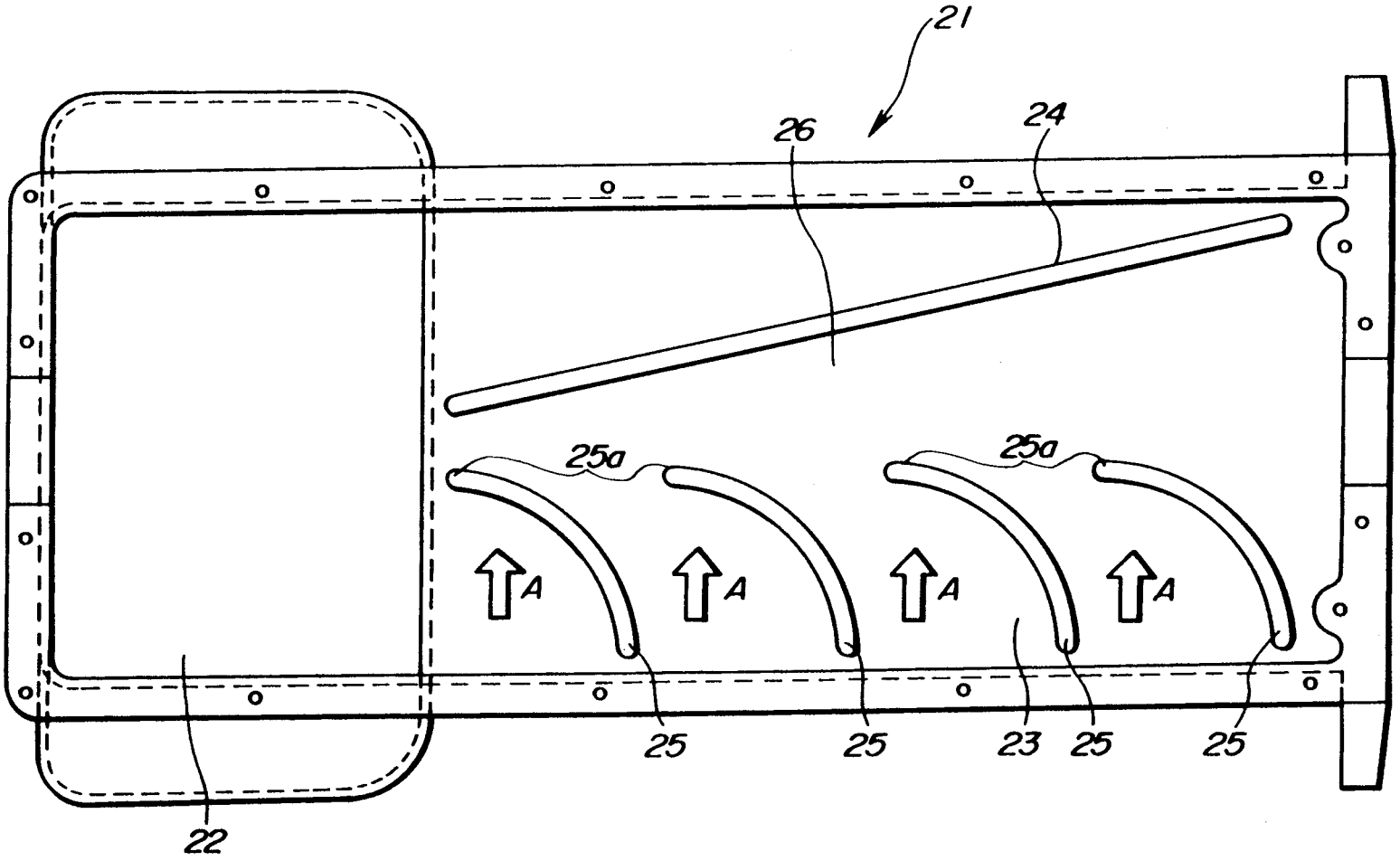
FIG. 6 (PRIOR ART)
FIG. 6 is a plan view of a conventional oil pan.

As clearly seen from FIG. 5, the guide ribs 5, 6, 7 are formed of a sheet metal and fixedly secured to the surface of the shallow bottom section 2 by welding.

The manner of operation of the thus arranged oil pan will be discussed hereinafter.

When the crankshaft (not shown) is rotated in the direction of arrows R in FIG. 3, the crankshaft counterweights and the like under rotation generate an air flow and directly strike the lubricating oil to cause the flow of the lubricating oil on the shallow bottom section 2. Therefore, the lubricating oil receives the force in the direction of arrows E of FIG. 1. Furthermore, since the guide ribs 5, 6, 7 are gradually curved toward the sump 3a as they approach the side wall 8, the lubricating oil changes its flowing direction so as to flow toward the sump 3a. Additionally, the oil return path 9 is formed to increase its width as it approaches the sump 3a, so that the lubricating oil is smoothly returned into the sump 3a through the oil return path 9.

With this structure, because the guide plate 12 is located opposite the guide ribs 5, 6, 7 as shown in FIG. 5, the oil through the oil return path 9 is rapidly returned into the sump 3a upon being guided by the guide plate 12 without overflowing the baffle plate 11. Furthermore, the returning oil is covered by the guide plate 12 to avoid contact with the rotating crankshaft, so that the oil is prevented from being splashed by the counterweights and the like, and from being mixed with the air bubbles.

Additionally, the guide ribs 5, 6, 7, the guide plate 12, and the oil guide tubes 17 are disposed at the downstream side of the oil flow caused by the rotation of the crankshaft, while the inlet 14 of the oil strainer 13 and the oil level sensor 15 are disposed at the upstream side of the oil flow caused by the rotation of the crankshaft. Therefore, there is a sufficient distance between the configuration disposed at the downstream side and that at the upstream side. Consequently, the oil sucked into the oil inlet 14 is separated from air bubbles while the oil at the downstream side is under a condition to be mixed with the air bubbles and to be changed in the oil level. Furthermore, the shake of the oil is suppressed at the sensor chamber 15. Accordingly, the oil in the sump 3a is sucked into the oil inlet 14 with no air bubbles and the oil level can be exactly measured by the oil level sensor 15.

In case the oil overflows a space formed between the guide plate 12 and the shallow bottom section 2, such as when a large amount of the oil is carried to the shallow bottom section 2 under an inclination of the automotive vehicle or the like, the oil is returned into the sump 3a through an entrance space (no numeral) formed between the shallow bottom section 2 and the other section of the baffle plate 11 facing the shallow bottom section 2. This prevents the lack of the oil in the sump 3a.

While only one embodiment has been shown and described, it will be understood that the foregoing and other changes in form and details can be made therein without departing from the spirit and scope of the invention.

What is claimed is:

1. An oil pan for an internal combustion engine, comprising:

a shallow bottom section fixedly disposed under a cylinder block of the engine, said shallow bottom section defining thereover a space in which a crankshaft is disposed;

a sump section defining a sump, located under the cylinder block of the engine, said sump section being connected with said shallow bottom section so that said sump is communicated with said shallow bottom section space, said sump having a lower part which is lower in level than said shallow bottom section; and at least one guide rib fixedly disposed on said shallow bottom section exclusively at one side which is located downstream of oil flow caused by rotation of the crankshaft, said guide rib being curved toward said sump as it approaches the downstream side of said shallow bottom section.

2. An oil pan as claimed in claim 1, further comprising a baffle plate fixedly disposed at an upper part of said sump, said baffle plate having a guide plate located opposite to said guide rib in a direction parallel with an axis of the crankshaft, said guide plate extending upwardly and having a width larger than a distance defined between said guide rib and a side wall forming part of a side surface of the downstream side of said shallow bottom section.

3. An oil pan as claimed in claim 1, wherein said sump is arranged such that an oil strainer is disposed therein, said oil strainer having an oil inlet which is located opposite to said guide plate in the direction of the oil flow caused by the rotation of the crankshaft.

4. An oil pan as claimed in claim 1, wherein said sump is fluidly connected to a sensor chamber disposed opposite to said guide plate in the direction of the oil flow caused by the rotation of the crankshaft, said sensor chamber having an oil level sensor therein.

5. An oil pan as claimed in claim 1, wherein said guide rib has an upstream end and a downstream end, said upstream end being generally located under a position which is between counterweights of the crankshaft, said downstream end being directed to said sump.

6. An oil pan as claimed in claim 1, wherein a length of said guide rib is not larger than one-third of the lateral width of the oil pan.

7. An oil pan as claimed in claim 1, wherein said at least one guide rib includes first, second and third guide ribs, said first guide rib being the farthest from said sump while said third guide rib is the nearest to said sump, said second guide rib being between said first and third guide ribs.

8. An oil pan as claimed in claim 7, wherein said first guide rib is longer than said second guide rib which is longer than said third guide rib, a radius of curvature of said first guide rib being larger than that of said second guide rib which is larger than that of said third guide rib.

9. An oil pan as claimed in claim 8, wherein said shallow bottom section defines an oil return path thereon, said oil return path being located between said guide ribs and said sump in a direction parallel with the crankshaft, said oil return path increasing in its width as it approaches said sump.

10. An oil pan as claimed in claim 1, wherein said shallow bottom section and said sump section are formed integral with each other.

* * * * *